US006918434B2

(12) United States Patent
Strähle

(10) Patent No.: US 6,918,434 B2
(45) Date of Patent: Jul. 19, 2005

(54) REINFORCED STACKED PLATE HEAT EXCHANGER

(75) Inventor: Roland Strähle, Unterensingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/666,686

(22) Filed: Sep. 18, 2003

(65) Prior Publication Data

US 2004/0112579 A1 Jun. 17, 2004

(30) Foreign Application Priority Data

Sep. 19, 2002 (DE) ..... 102 43 522

(51) Int. Cl.[7] ..... F28F 3/00

(52) U.S. Cl. ..... 165/167; 165/174; 165/178; 165/906

(58) Field of Search ..... 165/166, 167, 165/153, 174, 906, 916, 178

(56) References Cited

U.S. PATENT DOCUMENTS

| | | | | | |
|---|---|---|---|---|---|
| 1,816,111 | A | * | 7/1931 | De Ferranti et al. | 165/170 |
| 2,368,732 | A | * | 2/1945 | Wallgren | 165/167 |
| 2,617,634 | A | * | 11/1952 | Jendrassik | 165/167 |
| 5,165,468 | A | * | 11/1992 | Tajima et al. | 165/167 |
| 5,307,869 | A | * | 5/1994 | Blomgren | 165/167 |
| 5,325,915 | A | * | 7/1994 | Fouts et al. | 165/906 |
| 5,435,383 | A | * | 7/1995 | Rajagopal | 165/167 |
| 5,492,171 | A | * | 2/1996 | Kallrot | 165/167 |
| 5,671,807 | A | * | 9/1997 | Lameris | 165/178 |
| 5,810,071 | A | * | 9/1998 | Pavlin | 165/167 |
| 5,931,219 | A | * | 8/1999 | Kull et al. | 165/167 |
| 6,145,587 | A | * | 11/2000 | Hanafusa | 165/174 |
| 6,161,615 | A | * | 12/2000 | Brieden et al. | 165/166 |

FOREIGN PATENT DOCUMENTS

| | | |
|---|---|---|
| DE | 3020557 | 12/1981 |
| DE | 3215961 | 11/1983 |
| FR | 2634276 | 4/1989 |

* cited by examiner

*Primary Examiner*—Leonard R. Leo
(74) *Attorney, Agent, or Firm*—Wood, Phillips, Katz, Clark & Mortimer

(57) ABSTRACT

A heat exchanger with a plurality of stacked plates between a cover plate and a base plate. Channels are defined between the plates, with each plate including four openings defining four passages through the stacked plates, two passages being input and output passages for one fluid and the other two passages being input and output passages for a second fluid, where the two fluids flow between their input and output passages through alternating defined channels. A reinforcing body is disposed in at least one of the passages through the stacked plates, and is secured to the cover plate and the base plate and spaced from the sides of the openings defining the at least one passage in the stacked plates between the cover and base plates.

20 Claims, 2 Drawing Sheets

REINFORCED STACKED PLATE HEAT EXCHANGER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward heat exchangers, and particularly toward housing-less stacked plate heat exchangers.

BACKGROUND OF THE INVENTION AND TECHNICAL PROBLEMS POSED BY THE PRIOR ART

Stacked plate, or "housing-less" heat exchangers are known in the art. For example, as illustrated in DE OS 30 21 246 (which is probably intended for us in the food processing field), such heat exchangers include a stack of plates which are secured together around their edges to define closed channels between the plates. Aligned openings in the plates define passages through the plate stack for input and output of fluids, such as gaseous or liquid coolants, between which heat is to be exchanged. Seals are provided between the plates around selected openings to block selected defined passages from communication with selected plate channels, such that two separate fluid paths may be provided, typically with the separate paths defined in alternating channels in the stack. Flow path defining elements such as serpentine fins have also been provided in the channels of some stacked plate art heat exchangers to assist in heat exchange, both by carrying heat from the space to the plates and also by assisting in spreading flow across the plates to maximize the effective heat exchange surfaces.

However, such stacked plate heat exchangers have not been readily usable in applications using fluids which are under particularly high pressures.

The present invention is directed toward overcoming one or more of the problems set forth above.

SUMMARY OF THE INVENTION

In one aspect of the present invention, a heat exchanger for exchanging heat between a first fluid and a second fluid is provided, including a plurality of stacked plates, including a cover plate on one side of the stacked plates and a base plate on the other side of the stacked plates. The plates are spaced from one another to define channels therebetween, with each of the plates except the base plate including first, second, third and fourth openings therethrough, which openings are aligned to define first, second, third and fourth passages through the stacked plates. The first and third passages are input and output passages, respectively, for the first fluid, and the second and fourth passages are input and output passages, respectively, for the second fluid. The first fluid input and output passages communicate with a first group of the defined channels, and the second fluid input and output passages communicate with a second group of the defined channels, with the channels of the first group being alternately disposed between the channels of the second group. A reinforcing body is disposed in one of the first, second, third and fourth passages, and is secured to the cover plate and the base plate and spaced from the sides of the openings defining the one passage in the stacked plates between the cover and base plates.

In one form of this aspect of the present invention, a fluid flow path is defined between the reinforcing body and the aligned openings defining the one passage.

In another form of this aspect of the invention, the reinforcing body is a substantially cylindrical rod and the one passage is substantially round whereby fluid passes through an annular portion of the one passage around the reinforcing body.

In still another form of this aspect of the invention, the opening of the cover plate defining the one passage has a collar therearound defining a diameter smaller than the diameter of the openings of the other plates defining the one passage, the reinforcing member has a neck secured in the collar, and fluid openings extend through the collar communicating with the one passage. This form may further include a connector secured to the cover plate and adapted to connect with a fluid line whereby fluid may flow between the fluid line and the one passage through the fluid openings. Further, the reinforcing member neck may be soldered in the collar, or the collar may be an integrally formed deformation of the cover plate, or the collar may be a ring fixed to the cover plate. Still further, a fluid flow path may be defined between the reinforcing body and the aligned openings defining the one passage, with the fluid flow path having a cross-sectional area substantially the same as the total cross-sectional area of the collar fluid openings. Additionally, the base plate may include a flange with the reinforcing member soldered to the base plate flange with this form, and the flange may be an integrally formed deformation of the base plate.

In yet another form of this aspect of the invention, the first and second fluids are different, with the first fluid being $CO_2$ for vehicle air conditioner refrigerant and the second fluid being engine coolant in a still further form.

In yet another form of this aspect of the present invention, the plates have a generally flat heat exchange surface generally surrounded by a beveled edge, and the plates are stacked by nesting the plates with the beveled edges together and the flat heat exchange surfaces spaced. In a further form, wherein the beveled edges of nested plates are soldered together.

In still another form of this aspect of the invention, first spacing rings are provided around the first and third passages blocking communication of the first fluid input and output passages with the second group of defined channels, and second spacing rings are provided around the second and fourth passages blocking communication of the second fluid input and output passages with the first group of defined channels. In a further form, the first spacing rings are secured in the space between the plates defining the second group of defined channels.

In yet another form, alternating plates between the cover plate and the base plate have a thickness generally corresponding to the thickness of the cover and base plates, and the plates between the alternating plates have a thickness less than the cover and base plate thickness.

In another aspect of the present invention, a heat exchanger such as described with the first aspect of the invention is provided, further including a second reinforcing body disposed in the third passage, with the second reinforcing body being secured to the cover plate and the base plate and spaced from the sides of the openings defining the third passage in the stacked plates between the cover and base plates.

In one form of this aspect of the invention, the plates are generally rectangular, and the first and third passages are disposed adjacent opposite corners of the plates.

In another form of this aspect of the invention, the first fluid is $CO_2$ for vehicle air conditioner refrigerant and the second fluid is engine coolant.

In yet another form of this aspect of the invention, third and fourth reinforcing bodies are provided in the second and fourth passages, respectively, where the third reinforcing body is secured to the cover plate and the base plate and spaced from the sides of the openings defining the second passage in the stacked plates between the cover and base plates, and the fourth reinforcing body is secured to the cover plate and the base plate and spaced from the sides of the openings defining the fourth passage in the stacked plates between the cover and base plates.

DETAILED DESCRIPTION OF THE INVENTION

Figure 1:
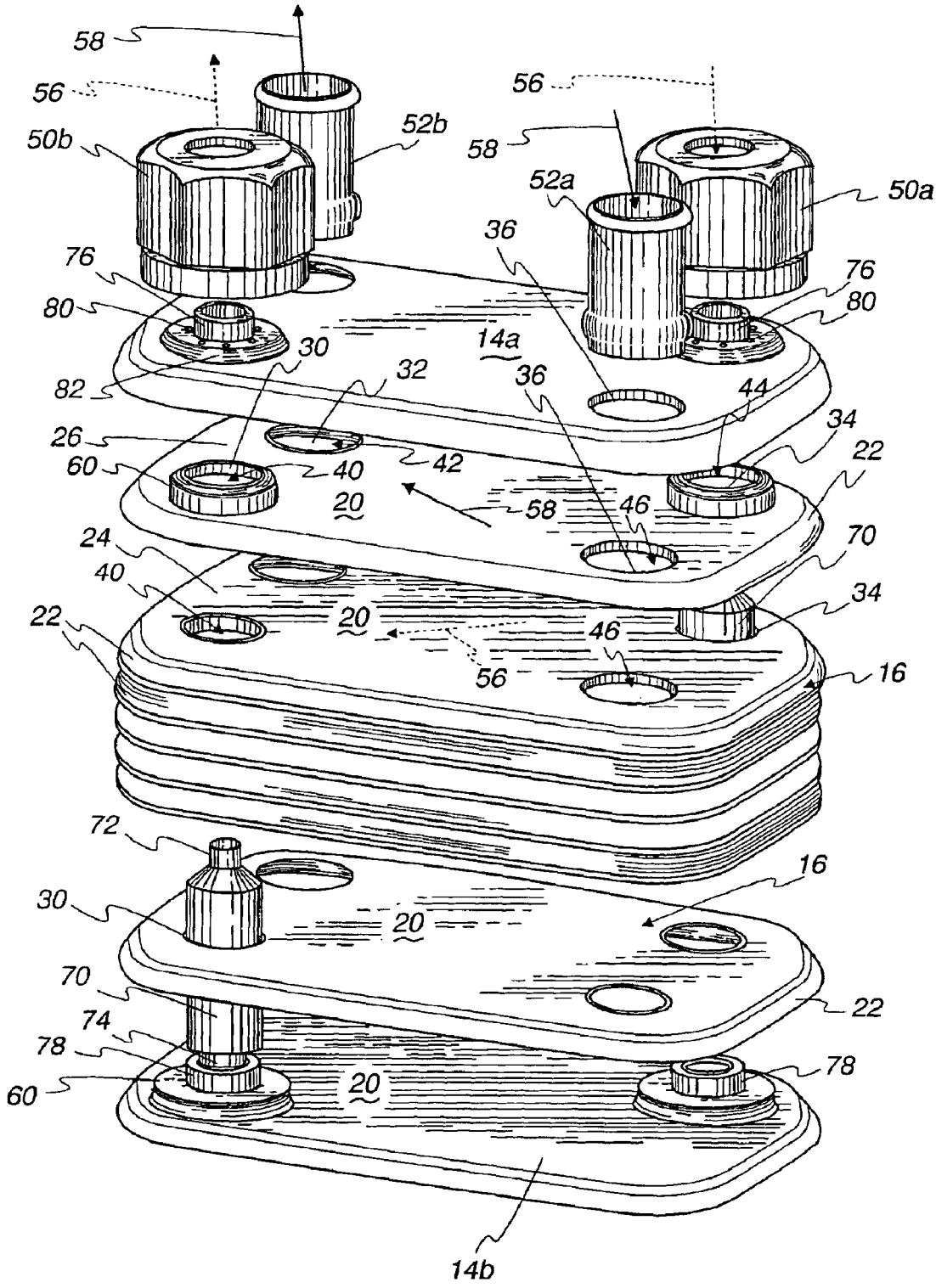
FIG. 1 is an exploded view of a stacked plate heat exchanger embodying the present invention.
Figure 2:
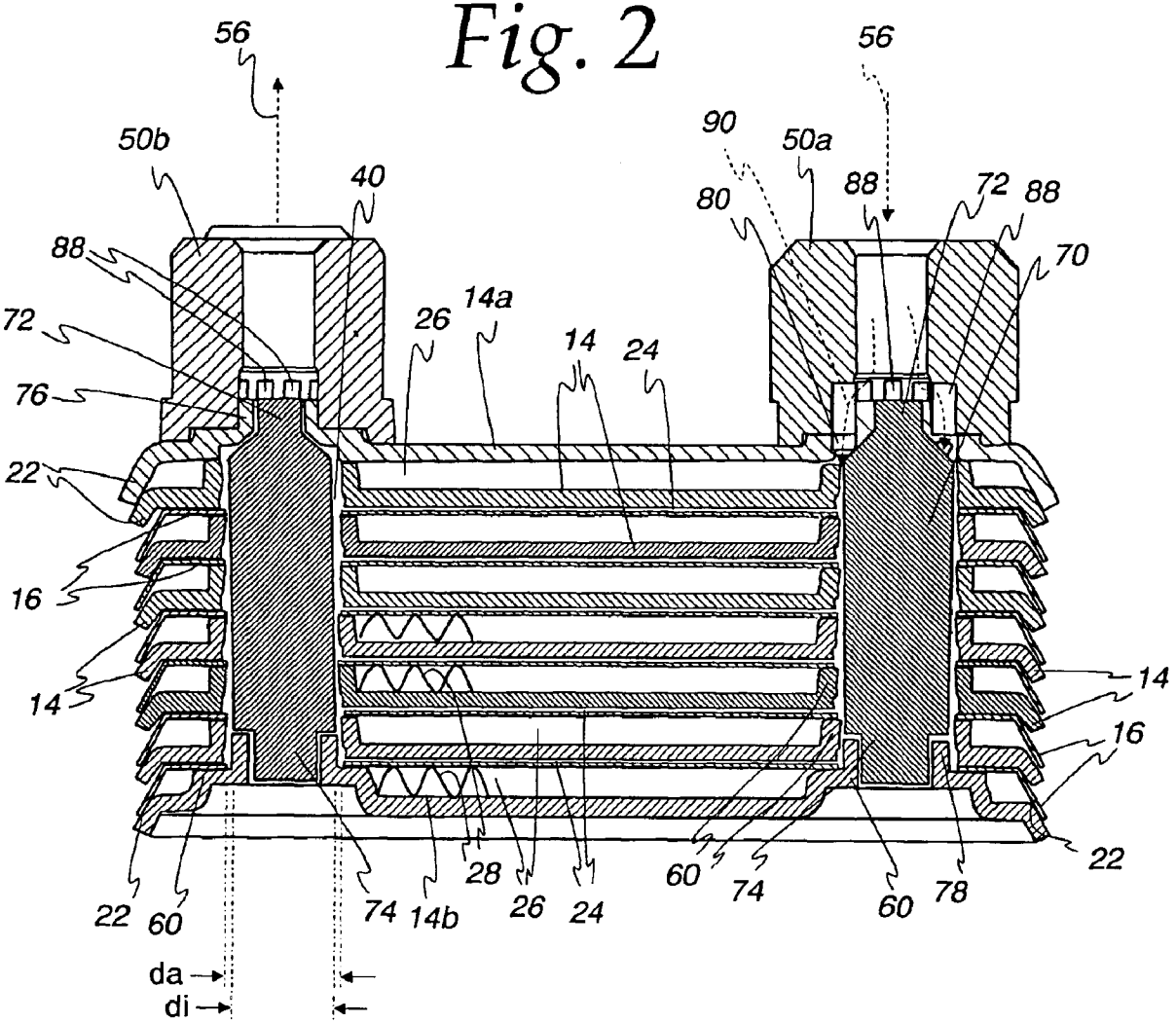
FIG. 2 is a cross-sectional view taken diagonally through a stacked plate heat exchanger such as illustrated in FIG. 1, with the cross-sectional plane through the two connectors being different for illustrative purposes.

A stacked plate heat exchanger 10 embodying the present invention is illustrated in FIGS. 1–2.

The heat exchanger 10 consists of a plurality of generally rectangular plates 14, 16, including top and bottom plates 14*a*, 14*b*. The plates 14, 14*a*, 14*b*, 16 include a generally flat portion 20 surrounded by beveled edges 22, and are stacked or nested together with a space between adjacent plate flat portions 20 as described further below. In this manner, alternating flow channels 24, 26 are defined between the plates, with a first group of flow channels 24 being every second channel (i.e., those located in the space above the flat portion 20 of each plate 16 and below the flat portion 20 of the adjacent plate 14) and a second group of flow channels 26 being the alternating every second channels defined in the space above the flat portion 20 of each plate 14 and below the flat portion 20 of the adjacent plates 16, 14*a*.

The plates 14, 14*a*, 14*b*, 16 may consist of aluminum sheets coated with solder, with their size and shape chosen according to the intended use. In the illustrated embodiment, plates 14, 14*a*, 14*b* are relatively thicker than plates 16.

Traversable plates such as serpentine fins 28 (see FIG. 2, which illustrates some but not all such fins 28) may be inserted between plates 14, 14*b*, 16 in the flow channels 26 in a suitable manner, with the crests suitably secured to the plates as by soldering. The fins 28 provide greater pressure resistance for the heat exchanger, and additionally assist in heat exchange as well as assisting in guiding and spreading the flow of fluid through the flow channels 26.

In the illustrated embodiment, plates 14, 14*a*, 16 each include a generally circular opening 30, 32, 34, 36 adjacent each corner. Since the fluid inputs and outputs are through the top plate 14*a*, openings are not provided through the bottom plate 14*b*. However, it should be understood that in alternate embodiments, two openings could be provided in each of the top and bottom plates, for example, where the system environment would advantageously accommodate two of the inputs and outputs on one side and the other two on the other side. Similarly, three openings could be provided in one of the top and bottom plates and one in the other of the top and bottom plates within the scope of the present invention.

The aligned openings 30, 32, 34, 36 of the plates define passages 40, 42, 44, 46 extending through all but the bottom plate 14*b* of the heat exchanger 10. Suitable connectors 50*a*, 50*b*, 52*a*, 52*b* (described in greater detail hereafter) are provided to connect to the source of fluids between which heat is being exchanged. While heat exchangers embodying the present invention could be advantageously used in applications in which heat is exchanged between any two selected gaseous or liquid fluids, the illustrated heat exchanger 10 is contemplated for use with a vehicle, with the fluids being engine coolant and $CO_2$ used as a vehicle air conditioner refrigerant. It will be appreciated by those skilled in this art that since the $CO_2$ is at such high pressure, the spacing between the plates 14, 16 defining the first group of flow channels 24 is significantly less than the spacing defining the second group of flow channels 26 (through which liquid engine coolant flows).

Thus, as indicated by the arrows 56 (and as explained in greater detail below), $CO_2$ flows from inlet connector 50*a*, to passage 44, to the various channels 24, to passage 40, and out connector 50*b*. Similarly, as indicated by the arrows 58, the engine coolant flows from inlet connector 52*a*, to passage 46, to the various channels 24, to passage 42, and out connector 52*b*. It will be appreciated that, with heat exchangers of this type, suitable spacing elements may be provided around selected ones of the aligned openings so as to either to block a passage from a channel (where such flow is not desired) or to provide an open gap from a passage to a channel (where such flow is desired) (e.g., by providing such spacers only at the other passages at that channel).

For example, as best illustrated in FIG. 2, flanges forming upwardly extending collars 60 of the thicker plates 14 are provided around the openings 30, 34 defining the passages 40, 44 for the $CO_2$. Those collars 60 are sealingly secured to the plates 16 above them, thereby blocking flow of $CO_2$ into the second group of channels 26. Since no such collars are provided around the other openings 32, 36 of the thicker plates 14 (see FIG. 1), it will be appreciated that there will be a gap between the plates 14, 16 at those other openings 32, 36, whereby engine coolant will be able to flow between the passages 42, 46 and the second group of channels 26. A similar arrangement is provided above the plates 16, whereby engine coolant in the passages 42, 46 is blocked from the channels 24 defined there, whereas a gap (albeit significantly smaller than with channels 26) around the passages 40, 44 allows flow of $CO_2$ between the passages 40, 44 and the first group of channels 24.

It should be appreciated that flow according to arrows 56, 58 is merely one arrangement which may be used, and that other cross-current or counter-current arrangements could also be used.

In accordance with the present invention, a reinforcing body 70 may be provided in at least one of the passages 40, 42, 44, 46, including providing such bodies in all of the passages 40, 42, 44, 46. In the illustrated embodiment, two such bodies 70 are provided, in the passages 40, 44 through which the high pressure $CO_2$ flows.

The reinforcing bodies 70 are generally similar in cross-sectional shape to the shape of the passages 40, 44, though somewhat smaller in size. With circular openings 30, 34 and cylindrical reinforcing bodies 70, therefore, a generally ring-shaped or annular passage having an inner diameter "di" and an outer diameter "da" is defined for flow of the $CO_2$. Such an annular passage configuration may contribute to excellent distribution of the fluid (e.g., $CO_2$ refrigerant) to all the flow channels 24 so that a very good heat exchange rate is achieved when a large number of flow channels 24 formed from the heat exchanger plates 14, 16 are provided. The annular flow path passes through the entire plate stack and therefore distributes the $CO_2$ to those flow channels 24. However, it should be recognized that the flow path need not be formed with the same dimensions, or annularly, over the entire plate stack (i.e., the cross section of the bodies 70 that determine the flow path need not be designed to be uniform over the entire stack).

Moreover, the reinforcing bodies 70 may be tapered on their ends to reduced neck portions 72, 74 on opposite ends, which neck portions 72, 74 are suitably secured (as by soldering) into collars 76, 78 defining a reduced diameter around the openings 30, 34 in the cover plate 14*a* and base plate 14*b*. The collars 76, 78 may be formed in any suitable manner, as by deformation of the plates 14*a*, 14*b*. A direct connection between the neck portions 72, 74 of the bodies 70 and the base plate 14*b* or cover plate 14*a* can be provided, for example, by soldering the neck portions 72, 74 directly into or onto the collars 76, 78 of the base plate 14*b* or cover plate 14*a*. The connection may also be made indirectly within the scope of the invention, however, with an intermediate element such as a sleeve or other similar individual part used.

It should thus be appreciated that the bodies 70 will serve to provide a strong reinforcement of the stacked plates 14, 14*a*, 14*b*, 16, assisting in holding the plates together notwithstanding the potentially high pressures between the plates (e.g., the high pressure of the $CO_2$ in the first group of channels 24). For example, with the illustrated soldered structure heat exchanger 10 constructed from aluminum sheet coated with solder and the body extends essentially through the entire distribution or collection channel, extremely good pressure stability is provided such as is particularly suitable for heat exchange between the refrigerant (e.g., $CO_2$) of an air conditioner and the engine coolant of the vehicle. Such refrigerant is known to be under a very high pressure of up to about 150 bar operating pressure, requiring such heat exchanger to withstand a maximum pressure of about 450 bar without losing their function. Moreover, this pressure stability can be provided without the use of larger sheet thicknesses which present their own cost and weight drawbacks (weight being a particularly important factor in vehicular applications).

In order to provide fluid (e.g., $CO_2$) flow between the connectors 50*a*, 50*b* and the annular passages 40, 44, suitable fluid openings 80 may be provided through a flange portion 82 around the collar 76 in the cover plate 14*a*. The flange portion 82 may be used to assist in properly securing the connectors 50*a*, 50*b* to the cover plate 14*a* (e.g., by metallic bonding such as soldering) to ensure such desired flow. Specifically, as best shown in the cross-sectional view of connector 50*a* on the right of FIG. 2, the connectors 50*a*, 50*b* may have lateral slots 88 which are aligned with the fluid openings 80 whereby fluid (e.g., $CO_2$) may flow through the slots 88 and fluid openings 80 (as shown by arrows 90) and around the securement of the reinforcing bodies 70 and collars 76 on the cover plate 14*a*.

In should be appreciated that the above described connection between the cover plate 14*a* and the reinforcing bodies 70 is merely illustrative, and that any such connection which will provide the described reinforcement as well as allow the desired fluid flow could also advantageously be used in connection with the present invention. However, the illustrated design is particularly advantageous since it ensures that the fluid flow can be produced more easily in terms of design and manufacture. Nevertheless, it should be appreciated that by providing the described flow paths around the reinforcing bodies 70, it is possible to offer significant design freedom, without significantly enlarging the entire cross-sectional surface (which could detrimentally affect pressure forces acting in the plate heat exchanger). Further, the reinforcing bodies 70, openings 30, 34 defining passages 40, 44, fluid openings 80, and connectors 50*a*, 50*b* may be advantageously sized so that the defined annular passages (which may have a small radial dimension of, e.g., only 6 mm) around the reinforcing bodies 70 correspond roughly to the cross-sectional surface of the fluid openings 80 and connector lateral slots 88 in order to create favorable flow conditions.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A heat exchanger for exchanging heat between a first fluid and a second fluid, comprising:

a plurality of stacked plates, including a cover plate on one side of the stacked plates and a base plate on the other side of the stacked plates, wherein said plates have flat portions spaced from one another to define channels therebetween, each of said plates except said base plate include first, second, third and fourth openings therethrough, said openings being aligned to define first, second, third and fourth passages through said stacked plates, said first and third passages being input and output passages, respectively, for said first fluid and said second and fourth passages being input and output passages, respectively, for said second fluid, and said first fluid input and output passages communicate with a first group of said defined channels and said second fluid input and output passages communicating with a second group of said defined channels, said channels of said first group being alternately disposed between said channels of said second group;

a reinforcing body disposed in one of said first, second, third and fourth passages, said reinforcing body being secured to said cover plate and said base plate and spaced from the sides of the openings defining said one of said first, second, third and fourth passages in said stacked plates between said cover and base plates, wherein the opening of said cover plate defining said one passage has a collar therearound defining a diameter smaller than the diameter of the openings of the other plates defining said one passage, said reinforcing body has a neck secured in said collar, and fluid openings extend through said collar communicating with said one passage; and a connector secured to said cover plate and adapted to connect with a fluid line whereby fluid may flow between said fluid line and said one passage through said fluid openings.

2. The heat exchanger of claim 1, wherein a fluid flow path is defined between the reinforcing body and the aligned openings defining said one passage.

3. The heat exchanger of claim 1, wherein said reinforcing body is a substantially cylindrical rod and said one passage is substantially round whereby fluid passes through an annular portion of said one passage around said reinforcing body.

4. The heat exchanger of claim 1, wherein said reinforcing body neck is soldered in said collar.

5. The heat exchanger of claim 1, wherein said collar is an integrally formed deformation of said cover plate.

6. The heat exchanger of claim 1, wherein said collar is a ring fixed to said cover plate.

7. The heat exchanger of claim 1, wherein:

a fluid flow path is defined between the reinforcing body and the aligned openings defining said one passage; and said fluid flow path having a cross-sectional area substantially the same as the total cross-sectional area of said collar fluid openings.

8. The heat exchanger of claim 1, wherein said base plate includes a flange, and said reinforcing body is soldered to said base plate flange.

9. The heat exchanger of claim 8, wherein said flange is an integrally formed deformation of said base plate.

10. The heat exchanger of claim 1, wherein said first and second fluids are different.

11. The heat exchanger of claim 10, wherein said first fluid is $CO_2$ for vehicle air conditioner refrigerant and said second fluid is engine coolant.

12. The heat exchanger of claim 1, wherein said plates have a generally flat heat exchange surface generally surrounded by a beveled edge, and said plates are stacked by nesting said plates with said beveled edges together and said flat heat exchange surfaces spaced.

13. The heat exchanger of claim 12, wherein said beveled edges of nested plates are soldered together.

14. The heat exchanger of claim 1, further comprising:

first spacing rings around said first and third passages blocking communication of said first fluid input and output passages with said second group of defined channels; and second spacing rings around said second and fourth passages blocking communication of said second fluid input and output passages with said first group of defined channels.

15. The heat exchanger of claim 14, wherein said first spacing rings are secured in the space between said plates defining said second group of defined channels.

16. A heat exchanger for exchanging heat between a first fluid and a second fluid, comprising:

a plurality of stacked plates, including a cover plate on one side of the stacked plates and a base plate on the other side of the stacked plates, wherein said plates have flat portions spaced from one another to define channels therebetween, each of said plates except said base plate include first, second, third and fourth openings therethrough, said openings being aligned to define first, second, third and fourth passages through said stacked plates, said first and third passages being input and outout passages, respectively, for said first fluid and said second and fourth passages being input and output passages, respectively, for said second fluid, and said first fluid input and outout passages communicate with a first group of said defined channels and said second fluid input and outout passages communicating with a second group of said defined channels, said channels of said first group being alternately disposed between said channels of said second group; and a reinforcing body disposed in one of said first, second, third and fourth passages, said reinforcing body being secured to said cover plate and said base plate and spaced from the sides of the openings defining said one of said first, second, third and fourth passages in said stacked plates between said cover and base plates;

wherein alternating plates between said cover plate and said base plate have a thickness generally corresponding to the thickness of the cover and base plates, and said plates between said alternating plates have a thickness less than said cover and base plate thickness.

17. A heat exchanger for exchanging heat between a first fluid and a second fluid, comprising:

a plurality of stacked plates, including a cover plate on one side of the stacked plates and a base plate on the other side of the stacked plates, wherein said plates have flat portions spaced from one another to define channels therebetween, each of said plates except said base plate include first, second, third and fourth openings therethrough, said openings being aligned to define first, second, third and fourth passages through said stacked plates, said first and third passages being input and output passages, respectively, for said first fluid and said second and fourth passages being input and output passages, respectively, for said second fluid, and said first fluid input and output passages communicate with a first group of said defined channels and said second fluid input and output passages communicating with a second group of said defined channels, said channels of said first group being alternately disposed between said channels of said second group;

a first reinforcing body disposed in said first passage, said first reinforcing body being secured to said cover plate and said base plate and spaced from the sides of the openings defining said first passage in said stacked plates between said cover and base plates; and a second reinforcing body disposed in said third passage, said second reinforcing body being secured to said cover plate and said base plate and spaced from the sides of the openings defining said third passage in said stacked plates between said cover and base plate;

wherein alternating plates between said cover plate and said base plate have a thickness generally corresponding to the thickness of the cover and base plates, and said plates between said alternating plates have a thickness less than said cover and base plate thickness.

18. The heat exchanger of claim 17, wherein said plates are generally rectangular, and said first and third passages are disposed adjacent opposite corners of said plates.

19. The heat exchanger of claim 17, wherein said first fluid is $CO_2$ for vehicle air conditioner refrigerant and said second fluid is engine coolant.

20. The heat exchanger of claim 17, further comprising:

a third reinforcing body disposed in said second passage, said third reinforcing body being secured to said cover plate and said base plate and spaced from the sides of the openings defining said second passage in said stacked plates between said cover and base plates; and a fourth reinforcing body disposed in said fourth passage, said fourth reinforcing body being secured to said cover plate and said base plate and spaced from the sides of the openings defining said fourth passage in said stacked plates between said cover and base plates.

* * * * *